US011532896B2

(12) United States Patent
Oh et al.

(10) Patent No.: US 11,532,896 B2
(45) Date of Patent: Dec. 20, 2022

(54) ANTENNA

(71) Applicant: LG INNOTEK CO., LTD., Seoul (KR)

(72) Inventors: Sae Won Oh, Seoul (KR); Young Hwan Kim, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 1 day.

(21) Appl. No.: 17/056,644

(22) PCT Filed: Apr. 30, 2019

(86) PCT No.: PCT/KR2019/005192
§ 371 (c)(1),
(2) Date: Nov. 18, 2020

(87) PCT Pub. No.: WO2019/240375
PCT Pub. Date: Dec. 19, 2019

(65) Prior Publication Data

US 2021/0203082 A1 Jul. 1, 2021

(30) Foreign Application Priority Data

Jun. 11, 2018 (KR) ..... 10-2018-0066653

(51) Int. Cl.
*H01Q 21/06* (2006.01)
*H01Q 1/38* (2006.01)
*H01Q 9/04* (2006.01)

(52) U.S. Cl.
CPC ..... *H01Q 21/065* (2013.01); *H01Q 1/38* (2013.01); *H01Q 9/04* (2013.01)

(58) Field of Classification Search
CPC ..... H01Q 1/38; H01Q 9/04; H01Q 9/0407; H01Q 9/0414; H01Q 9/0457; H01Q 21/065
See application file for complete search history.

(56) References Cited

U.S. PATENT DOCUMENTS 6,222,488 B1 4/2001 Pai-Chuan
10,763,591 B2 * 9/2020 Kirino ..... H01Q 21/064
2010/0171675 A1 7/2010 Borja et al.
(Continued)

OTHER PUBLICATIONS

M. Saad Khan et al. A Circularly Polarized Stacked Patch Antenna Array for Tracking Applications in S-Band., 2015 9th European Conference on Antennas and Propagation (EuCAP) [online], Apr. 17, 2015. (Year: 2015).*
(Continued)

*Primary Examiner* — Thai Pham
(74) *Attorney, Agent, or Firm* — Birch, Stewart, Kolasch & Birch, LLP

(57) ABSTRACT

An antenna according to one embodiment comprises: a substrate; a radiator attached to the substrate and radiating an electromagnetic signal; a metal plate antenna disposed to be spaced apart from the radiator in the vertical direction of the radiator; a fixing rod for supporting the metal plate antenna; and a sub patch antenna comprising a first surface attached to the fixing rod and a second surface attached to the substrate, wherein a partial region of the metal plate antenna and a partial region of the radiator overlap in the vertical direction.

21 Claims, 9 Drawing Sheets

(56) References Cited

U.S. PATENT DOCUMENTS

| | | | | |
|---|---|---|---|---|
| 2011/0068990 | A1* | 3/2011 | Grzyb | H01P 1/042 343/772 |
| 2014/0285382 | A1* | 9/2014 | Dobric | H01Q 9/0428 343/700 MS |
| 2017/0187121 | A1* | 6/2017 | Kirino | H01Q 21/005 |

OTHER PUBLICATIONS

Kim Won Nam, Ultra Wideband Patch Antenna, Aug. 21, 2017, KR 20170094740 A. (Year: 2017).*

* cited by examiner

【FIG.1】
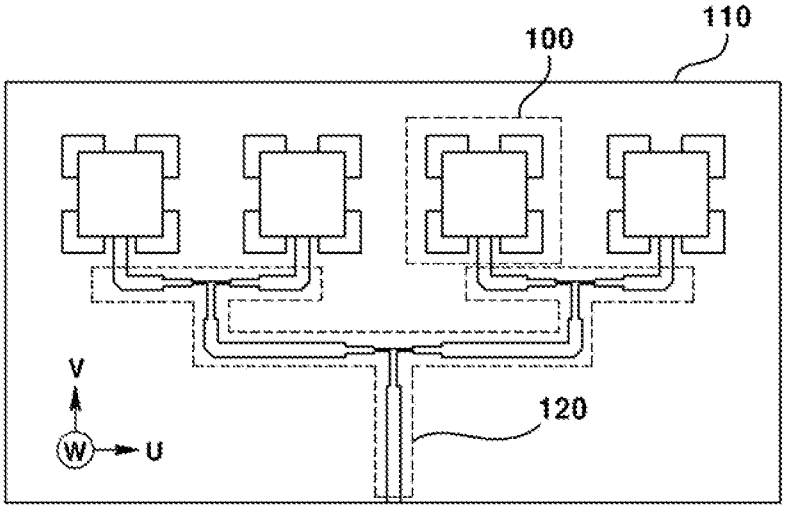

【FIG.2】
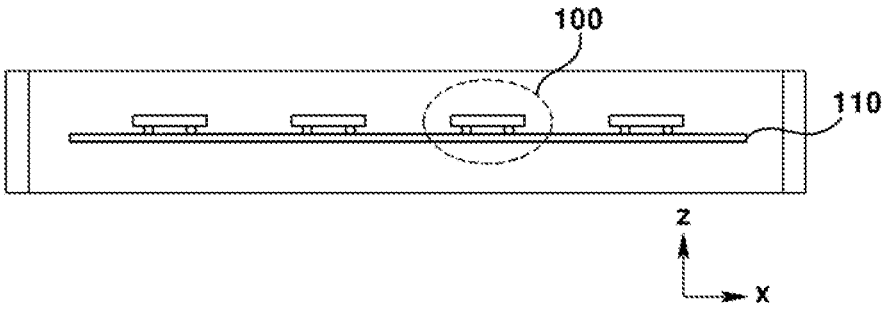

【FIG.3】
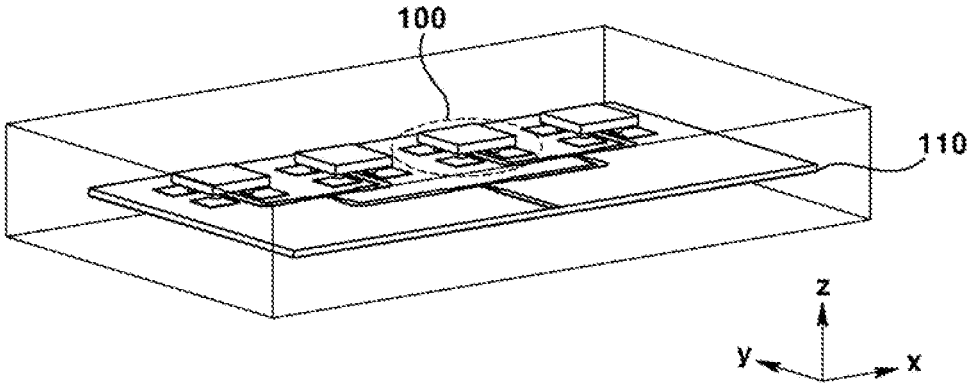

【FIG.4】
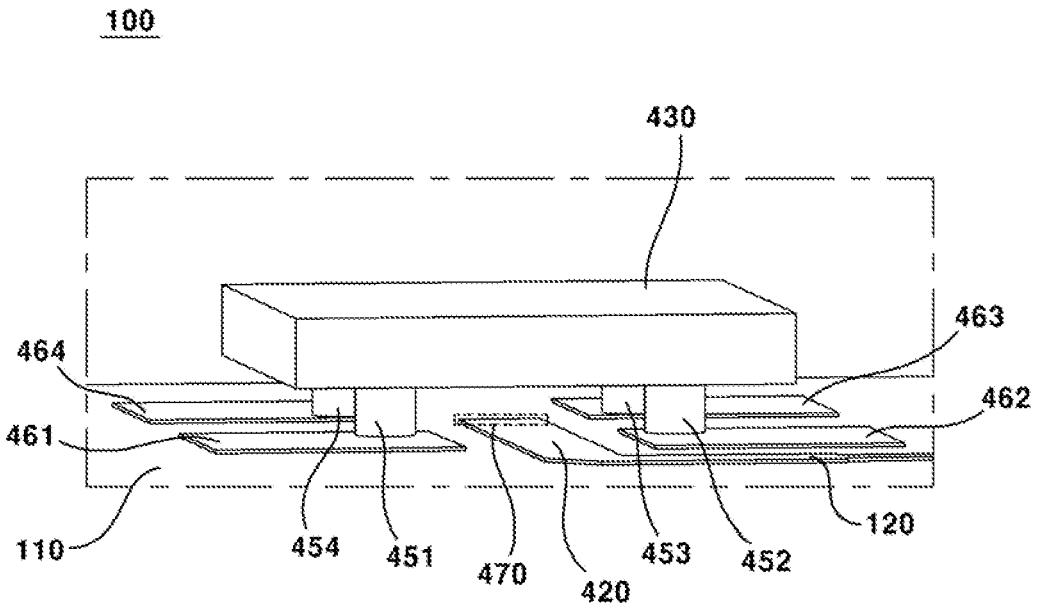

【FIG.5】
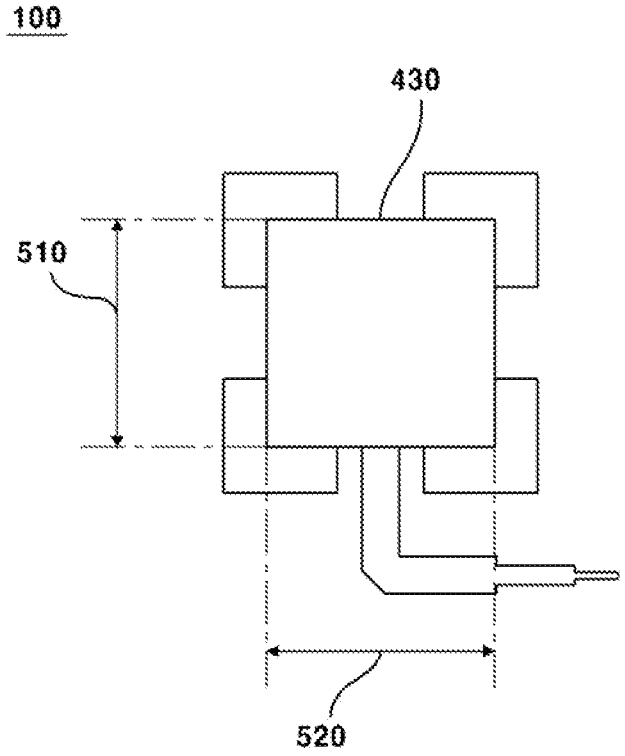

【FIG.6】
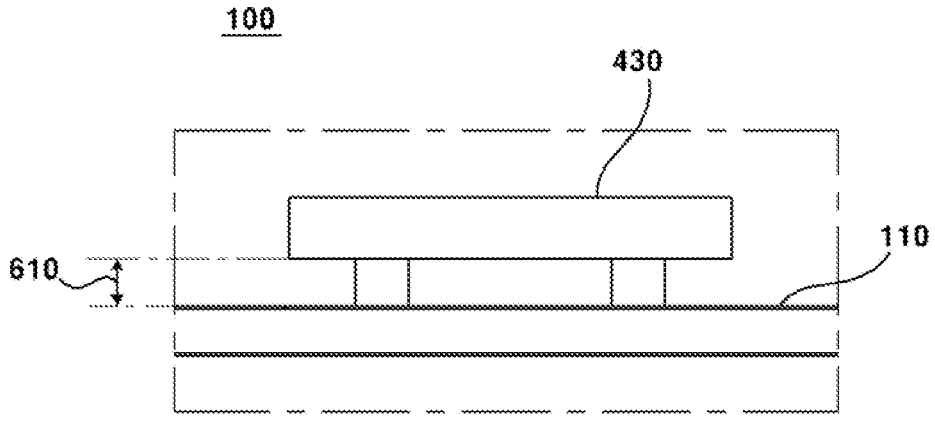

【FIG.7】
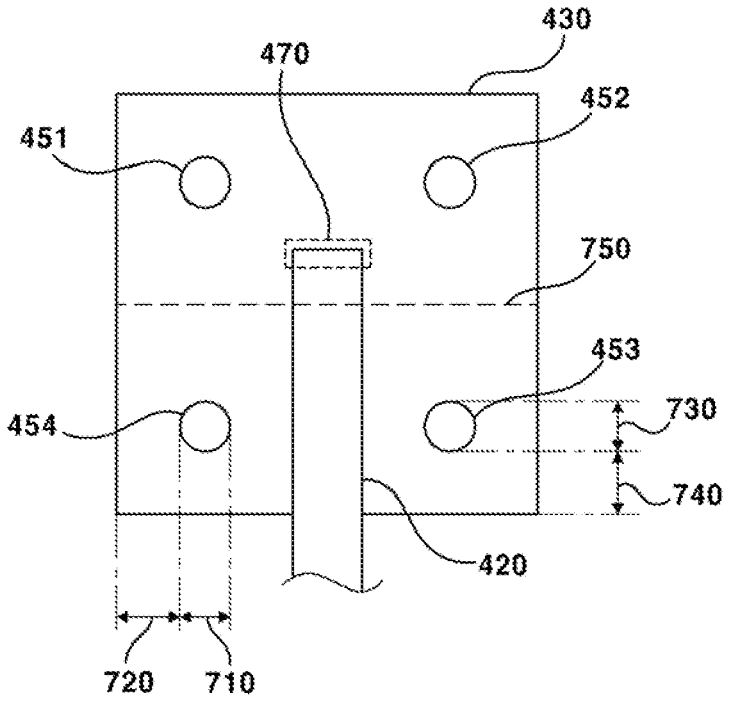

【FIG.8】
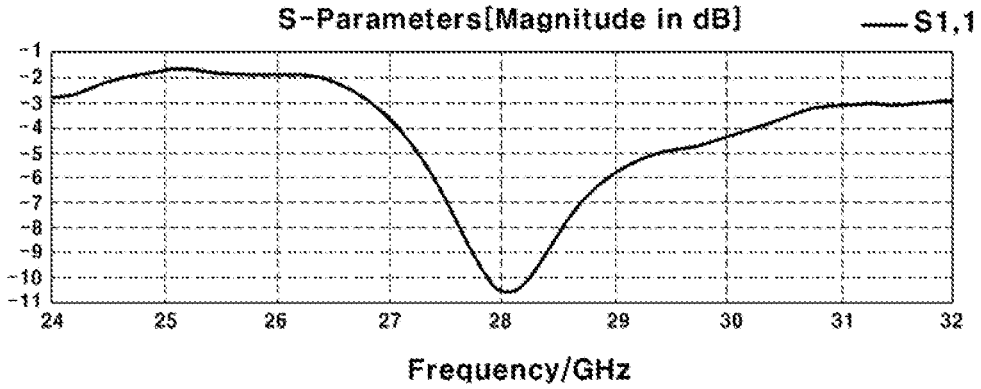

【FIG.9】
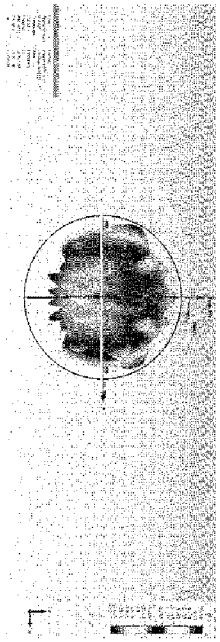

ANTENNA

CROSS REFERENCE TO RELATED APPLICATIONS

This application is the National Phase of PCT International Application No. PCT/KR2019/005192, filed on Apr. 30, 2019, which claims priority under 35 U.S.C. 119(a) to Patent Application No. 10-2018-0066653, filed in the Republic of Korea on Jun. 11, 2018, all of which are hereby expressly incorporated by reference into the present application.

TECHNICAL FIELD

The present disclosure relates to an antenna for transmitting and receiving an electromagnetic wave.

BACKGROUND ART

An array patch antenna of 28 GHz for 5G is formed in a patch-type array structure and uses Teflon substrate or Rogers substrate. The 28 GHz, which is a high frequency, is short in wavelength due to its high frequency characteristics. Therefore, the 28 GHz suffers from disadvantages in that performance changes occur in response to permittivity and substrate deviations. Thus, it is common to use Teflon substrate or Rogers substrate rather than using a substrate like FR4 having a high permittivity and relatively high loss.

However, use of Teflon substrate or Rogers substrate also suffers from problems in that product unit price increases due to high material cost and processing cost. As a result, many companies and researchers are developing new substrates of low unit cost replaceable of substrates such as Teflon substrate or Rogers substrate, and technologies of new types of array methods.

SUMMARY

The present disclosure may provide an antenna. To be more specific, the present disclosure discloses an antenna configured to decrease losses through an airgap despite using the same substrate as before. Technical subjects to be solved are not limited to those mentioned above, and may further include various technical subjects within a scope apparent to those skilled in the art.

In one general aspect of the present disclosure, there may be provided an antenna comprising: a substrate; a radiator attached to the substrate and radiating an electromagnetic signal; a metal plate antenna disposed to be spaced apart from the radiator in the vertical direction of the radiator; a fixing rod for supporting the metal plate antenna; and a sub patch antenna comprising a first surface attached to the fixing rod and a second surface attached to the substrate, wherein a partial region of the metal plate antenna and a partial region of the radiator overlap in a vertical direction.

Furthermore, the metal plate antenna may radiate an electromagnetic signal obtained from the radiator through coupling.

Furthermore, the sub patch antenna may radiate an electromagnetic signal obtained from the metal plate antenna through coupling.

Furthermore, a partial region of the metal plate antenna and a partial region of the radiator may overlap in the vertical direction.

Furthermore, the fixing rod may be disposed to be spaced apart at a predetermined distance from a corner part of the metal plate antenna.

Furthermore, a central region of the metal plate antenna and the radiator may be overlapped to the vertical direction.

Furthermore, a size of the metal plate antenna may be determined by a frequency of the electromagnetic signal to be radiated.

Furthermore, a separation distance between the radiator and the metal plate antenna may be determined by a frequency of the electromagnetic signal.

In another general aspect of the present disclosure, there may be provided an antenna comprising: a substrate; a radiator attached to the substrate to radiate an electromagnetic signal; a square-shaped metal plate antenna to be spaced apart to a vertical direction of the radiator; four (4) fixing rods supporting the metal plate antenna; and four (4) sub patch antennas respectively attached to the four fixing rods and disposed on the substrate, wherein a partial region of the metal plate antenna and a partial region of the radiator may overlap in the vertical direction, and the four (4) fixing rods may be respectively and correspondingly disposed on four corners of the square-shaped metal plate antenna.

Furthermore, a central region of the metal plate antenna and the radiator may be overlapped to the vertical direction.

Furthermore, a size of the metal plate antenna may be determined by a frequency of the electromagnetic signal to be radiated.

Furthermore, a separation distance between the radiator and the metal plate antenna may be determined by a frequency of the electromagnetic signal.

Advantageous Effects of Invention

The present disclosure provides an antenna. To be more specific, the present disclosure discloses an antenna configured to decrease loss through an airgap.

BRIEF DESCRIPTION OF THE DRAWINGS

FIG. 1 is a plane view illustrating a plurality of airgap antennas according to an exemplary embodiment of the present disclosure.

FIG. 2 is a front view illustrating a plurality of airgap antennas according to an exemplary embodiment of the present disclosure.

FIG. 3 is a perspective view illustrating a plurality of airgap antennas according to an exemplary embodiment of the present disclosure.

FIG. 4 is a perspective view illustrating an airgap antenna according to an exemplary embodiment of the present disclosure.

FIG. 5 is a plane view illustrating an airgap antenna according to an exemplary embodiment of the present disclosure.

FIG. 6 is a front view illustrating an airgap antenna according to an exemplary embodiment of the present disclosure.

FIG. 7 is a bottom view illustrating an airgap antenna according to an exemplary embodiment of the present disclosure.

FIG. 8 is a schematic view illustrating a return noise of an airgap antenna according to an exemplary embodiment of the present disclosure.

FIG. 9 is a schematic view illustrating a size of electromagnetic signal of a plurality of airgap antennas according to an exemplary embodiment of the present disclosure.

DETAILED DESCRIPTION

Hereinafter, exemplary embodiments of the present disclosure will be described in detail with reference to the accompanying drawings.

Various objects, advantages and features of the present disclosure will become apparent from the following description of exemplary embodiments with reference to the accompanying drawings. However, the present disclosure is not limited to the following exemplary embodiments but will be embodied in many mutually different forms, exemplary embodiments are provided so that this disclosure will be thorough, and will fully convey the scope to those skilled in the art, and will be simply defined by the scope of claims of the present disclosure. Wherever possible, the same reference numerals will be used throughout the drawings and the description to refer to the same or like parts.

Unless otherwise defined, all terms (including technical and scientific terms) used herein have the same meaning as commonly understood by one of ordinary skill in the art to which this general inventive concept belongs. It will be further understood that terms, such as those defined in commonly used dictionaries, should be interpreted as having a meaning that is consistent with their meaning in the context of the relevant art and/or the present application, and will not be interpreted in an idealized or overly formal sense unless expressly so defined herein.

Furthermore, the terminology used herein is for the purpose of describing particular example embodiments only and is not intended to be limiting. As used herein, the singular forms "a", "an" and "the" may be intended to include the plural forms as well, unless the context clearly indicates otherwise.

The terms "comprises," and/or "comprising" are inclusive and therefore specify the presence of stated elements, steps and/or operations, but do not preclude the presence or addition of one or more other elements, steps and/or operations thereof. As used herein, the term "and/or" includes any and all combinations of one or more of the associated listed items.

In describing the elements of the exemplary embodiments of the present disclosure, the terms first, second, A, B, (a), (b), etc. may be used herein. These elements, components, regions, layers and/or sections should not be limited by these terms. These terms may be only used to distinguish one element, essence or order from another element, essence or order. When an element is referred to as being "on", "engaged to", "connected to" or "coupled to" another element, it may be interpreted as being directly on, engaged, connected or coupled to the other element, or intervening elements may be present therebetween.

With reference to the following drawings, exemplary embodiments of the present disclosure will be described in detail to allow being easily implemented by the skilled in the art belonging to the present disclosure. However, this disclosure may, however, be embodied in many different forms and should not be construed as limited to the embodiments set forth herein.

The exemplary embodiments may disclose u, v, w according to the directions where w direction may be interpreted as being a vertical direction.

Furthermore, an "airgap antenna" described in the present disclosure may be interpreted as a common "antenna". As a result, an "airgap antenna" described in the present disclosure may mean a common "antenna", and the "airgap antenna" is described to easily distinguish from a metal plate antenna, a sub patch antenna and the like, for the convenience of description, and therefore, the present term may not be interpreted as limiting the scope of present disclosure in any manner.

Now, the exemplary embodiments of the present disclosure will be described in detail with reference to the accompanying drawings.

FIG. 1 is a plane view illustrating a plurality of airgap antennas according to an exemplary embodiment of the present disclosure.

An airgap antenna (100) according to an exemplary embodiment of the present disclosure may be disposed on a substrate (110).

The substrate (110) may be formed with materials such as LTCC (Low Temperature Co-fired Ceramic), Rogers, Teflon, FR4 of organic series. In consideration of cost aspect, although it would be preferable to use FR4 of low-priced organic series, LTCC may be used in order to implement an excellent feature at a high frequency band.

The substrate (110) may be a dielectric substrate having a constant permittivity (dielectric rate). Furthermore, a thickness of substrate (100) according to an exemplary embodiment of the present disclosure may vary in response to a subject to which a patch type antenna is applied or to a curvature but there is no particular limit to the thickness of substrate (100).

A plurality of airgap antennas may be disposed on the substrate (110).

Furthermore, as shown in FIG. 1, based on FIG. 1, a right-side direction may be explained as u direction (or x direction), an upper direction may be explained as v direction (or y direction) and a vertical direction may be explained as w direction (or z direction).

Furthermore, although the present disclosure has largely disclosed a case where a signal is radiated, it should be noted that the airgap antenna (100) may implement not only a signal radiation but also a signal reception. To be more specific, the airgap antenna (100) may implement the signal reception in a reverse order of radiating a signal, and therefore, explanation of signal reception will be omitted from the present disclosure in order to simplify an entire explanation.

Referring to FIG. 1, an electric signal may be transmitted through a line (120) on the substrate (110), and when an electric signal is transmitted up to the airgap antenna (100), the airgap antenna (100) may output a signal in the form of electromagnetic wave. To be more specific, the airgap antenna (100) may radiate an electromagnetic signal.

FIG. 2 is a front view illustrating a plurality of airgap antennas according to an exemplary embodiment of the present disclosure.

Referring to FIG. 2, it can be ascertained that a plurality of airgap antennas is disposed on the substrate (110). Although FIGS. 1 and 2 have illustrated that four (4) airgap antennas are disposed on the substrate, the present disclosure is not limited thereto, and one or more airgap antennas may be disposed on the substrate (110) in other shapes, or different numbers of airgap antennas may be disposed on the substrate (110).

As ascertained from FIG. 2, the airgap antenna (100) according to an exemplary embodiment of the present disclosure may be disposed with an airgap between a substrate and a metal plate antenna to allow being used as a dielectric material.

FIG. 3 is a perspective view illustrating a plurality of airgap antennas according to an exemplary embodiment of the present disclosure.

It can be evidenced from FIG. 3 that a plurality of airgap antennas is disposed on the substrate (110). Furthermore, it can be also noticed from FIG. 3 that an electric signal is transmitted through one line (120) before being bifurcated to four lines and transmitted to four airgap antennas.

When an electric signal is bifurcated to be transmitted to four airgap antennas, a line shape may be determined in order to reduce energy consumption. Furthermore, material of substrate (110) may affect the energy consumption generated in the course of electric signal transmission.

FIG. 4 is a perspective view illustrating an airgap antenna (100) according to an exemplary embodiment of the present disclosure.

As illustrated in FIG. 4, the airgap antenna (100) may include a radiator (420), a metal plate antenna (430), a fixing rod (451 to 454), and a sub patch antenna (461 to 464). However, it should be apparent to those skilled in the art that other general-purpose elements than those shown in FIG. 4 may be further included in the airgap antenna (100). For example, the airgap antenna (100) may further comprise a substrate (110). Alternatively, as in another exemplary embodiment, it should be apparent to those skilled in the art that some elements among those illustrated in FIG. 4 may be omitted.

Several elements of airgap antenna (100) according to an exemplary embodiment of the present disclosure may be disposed on the substrate (110). To be more specific, the substrate (110) may be attached with radiator (420) and sub patch antennas (461 to 464).

The radiator (420) according to an exemplary embodiment of the present disclosure may radiate an electric signal. The electric signal has a characteristic of being radiated at a position where transmission is discontinued. Thus, the electric signal transmitted through a line (120) to the radiator (420) may be radiated wirelessly from the radiator (420).

The electric signal may be transmitted to the radiator (420) through the line (120). A circuit may be so designed as to allow reducing losses in the course of an electric signal being transmitted through a line (120). Furthermore, material, permittivity and the like of substrate (110) may also affect the losses generated in the course of an electric signal being transmitted through a line (120).

In light of the fact that the radiator (420) according to an exemplary embodiment of the present disclosure radiates an electric signal, a distal end thereof may be manufactured in a straight-lined form, but the present disclosure is not limited thereto. Furthermore, in light of the fact that a radiator may be disposed on a substrate, the radiator (420) according to an exemplary embodiment of the present disclosure may be attached on to the substrate (110).

An electric signal radiated from the radiator (420) may be transmitted to a metal plate antenna (430) through coupling. Furthermore, the metal plate antenna (430) may radiate the electric signal received through the coupling in a form of an electromagnetic wave.

The metal plate antenna (430) according to an exemplary embodiment of the present disclosure may be so disposed as to be spaced apart to a vertical direction of the radiator (420). As a result, an airgap may be formed between the radiator (420) and the metal plate antenna (430). Furthermore, because there is no element configured to transmit an electric signal between the radiator (420) and the metal plate antenna (430), an electric signal may be transmitted from the radiator (420) to the metal plate antenna (430) through coupling. In this case, air may be used as a dielectric.

A partial region of the metal plate antenna (430) and a partial region of the radiator (420) may overlap in the vertical direction in an airgap antenna according to an exemplary embodiment of the present disclosure. Referring to FIG. 4, a partial region of radiator (420) may overlap with a central region of the metal plate antenna (430).

A position of distal end of the line at the radiator (420) may be determined by a used frequency and a separation distance between the substrate (110) and the metal plate antenna (430). According to an exemplary embodiment, a position of distal end of the line at the radiator (420) may be further disposed above than an intermediate line of the metal plate antenna (430) to a v direction. As a result, more than a half the length of an entire length of the v direction of the metal plate antenna (430) may be overlapped with the radiator (420).

Referring to FIG. 4, the metal plate antenna (430) according to an exemplary embodiment may take a shape of a rectangular parallelepiped. In this case, a cross-section of the metal plate antenna (430) according to an exemplary embodiment may take a shape of a square. The metal plate antenna (430) may take a cross-section of an arbitrary square shape such as rectangle, square and trapezoid. However, the cross-section of the metal plate antenna (430) according to an exemplary embodiment may not take a shape of a square unlike what is shown in FIG. 4. For example, the cross-section of the metal plate antenna (430) may take a shape of a circle, a triangle, a pentagon and the like, such that the shape of the metal plate antenna (430) may not be limited thereto.

The fixing rod (451 to 454) according to an exemplary embodiment may support the metal plate antenna (430). The fixing rod (451 to 454) can fix a position of the metal plate antenna (430), because the metal plate antenna (430) is spaced apart from the radiator (420) at a predetermined distance on the substrate (110).

Although FIG. 4 has illustrated four (4) sub patch antennas (461 to 464) and four (4) fixing rods (451 to 454), the present disclosure is not limited thereto. For example, one (1) U-shaped fixing rod may be used, and five (5) or more fixing rods may be also used. In case of using one (1) U-shaped fixing rod, a U-shaped open portion may be disposed to a radiator (420) direction to prevent the U-shaped fixing rod from being overlapped with the radiator (420).

The fixing rod (451 to 454) according to an exemplary embodiment is illustrated in FIG. 4 in the shape of a cylinder. As a result, a cross-section of the fixing rod (451 to 454) according to an exemplary embodiment may take a shape of a circle. However, the shape of the fixing rod (451 to 454) is not limited thereto, and may take a cone removed of a tip, a square cylinder and the like. Alternatively, a cross-section of the fixing rod (451 to 454) may take an arbitrary curved shape including a circle, an ellipse, a fan shape and the like. Alternatively, a cross-section of the fixing rod (451 to 454) may take an arbitrary shape including a rectangle, a square, a pentagon, a trapezoid.

The fixing rod (451 to 454) according to an exemplary embodiment may be so disposed as to be spaced apart at a predetermined distance from a corner portion of the metal plate antenna (430). For example, the fixing rod (451 to 454), when the fixing rod (451 to 454) takes a shape of a cylinder, may be so disposed as to be spaced apart from a corner portion of the metal plate antenna (430) as much as a length equal to or larger than a diameter of a circle showing a cross-section of the fixing rod (451 to 454).

Referring to FIG. 4, the four (4) fixing rods (451 to 454) according to an exemplary embodiment may be respectively and correspondingly disposed to four (4) corners of the square-shaped metal plate antenna (430) but the present disclosure is not limited thereto.

The fixing rod (451 to 454) may be manufactured with a material having a transmittance rate of electric signal less than a pre-set value. Because an electric signal does not actually pass through the fixing rod (451 to 454), the electric signal radiated from the radiator (420) may not be dispersed through the fixing rod (451 to 454), and instead may be dispersed through the metal plate antenna (430).

The sub patch antenna (461 to 464) according to an exemplary embodiment may be disposed on the substrate (110). The sub patch antenna (461 to 464) may include a first surface and a second surface. The first surface of sub patch antenna (461 to 464) may be attached to the fixing rod (451 to 454), and the second surface of sub patch antenna (461 to 464) may be attached to the substrate (110).

The sub patch antenna (461 to 464) according to an exemplary embodiment may radiate an electromagnetic signal obtained from the metal plate antenna (430) through the coupling. The sub patch antenna (461 to 464) may obtain the electromagnetic signal from both the radiator (420) and the metal plate antenna (430), but may obtain more amounts of electromagnetic signals from the metal plate antenna (430) than those of the radiator (420). Furthermore, although the sub patch antenna (461 to 464) may operate as an antenna by radiating the electromagnetic signals obtained through the coupling, the size of electromagnetic signals radiated by the sub patch antenna (461 to 464) may be smaller than that of the metal plate antenna (430).

A partial region of the metal plate antenna (430) and a partial region of the sub patch antenna (461 to 464) according to an exemplary embodiment may overlap in the vertical direction.

The size of overlapped region between the sub patch antenna (461 to 464) and the metal plate antenna (430) may be determined by a value pre-set for enhancement of efficiency of airgap antenna.

A plurality of sub patch antennas (461 to 464) according to an exemplary embodiment may be provided, and multiple beams may be formed through the sub patch antenna (461 to 464).

FIG. 5 is a plane view illustrating an airgap antenna (100) according to an exemplary embodiment of the present disclosure.

A case of the metal plate antenna (430) being of a rectangular shape will be explained through FIG. 5 according to an exemplary embodiment of the present disclosure.

In case of the metal plate antenna (430) being of a rectangular shape, the metal plate antenna (430) may be expressed as a first length (510) and a second length (520). The said first length (510) and/or the second length (520) may be determined by the purpose of airgap antenna (100). For example, the size of metal plate antenna (430) may be determined by frequency of electromagnetic signal to be radiated.

According to an exemplary embodiment of the present disclosure, the first length (510) and the second length (520) may determine a resonant frequency operated by the airgap antenna (100). As a result, the first length (510) and/or the second length (520) may be determined by the purpose of airgap antenna (100). Particularly, the fixing rod (451 to 454), when disposed on a corner portion of the metal plate antenna (430), may affect a resonant frequency operated by the airgap antenna (100) due to influence on an entire length of the metal plate antenna (430), such that the fixing rod (451 to 454) may be disposed at an inside from a corner portion of the metal plate antenna (430) as much as a predetermined length.

FIG. 6 is a front view illustrating an airgap antenna (100) according to an exemplary embodiment of the present disclosure.

An airgap may be formed as much as a length (610) between the metal plate antenna (430) and the substrate (110). The length (610) between the metal plate antenna (430) and the substrate (110) may be determined by a frequency to be used. For example, the length (610) between the metal plate antenna (430) and the substrate (110) may be 0.5 mm~0.7 mm on the airgap antenna (100) in response to a particular purpose.

FIG. 7 is a bottom view illustrating an airgap antenna (100) according to an exemplary embodiment of the present disclosure.

The fixing rod (451 to 454) disposed on a corner portion of the metal plate antenna (430) may affect an entire length of the metal plate antenna (430) to resultantly affect the resonant frequency operated by the airgap antenna (100), such that the fixing rod (451 to 454) may be disposed at an inside from the corner portion of the metal plate antenna (430) as much as a predetermined length.

To be more specific, a length (720) from a corner to the fixing rod (451 to 454) may be greater than a length (710) to a first direction of the fixing rod (451 to 454). Alternatively, a length (740) from a corner to the fixing rod (451 to 454) may be greater than a length (730) of a second direction of the fixing rod (451 to 454).

However, the aforementioned exemplary embodiment is applicable to a case where a cross-section of the fixing rod (451 to 454) is of a circle or of an oval shape, and the present disclosure is not limited to the given exemplary embodiment.

A position of a distal end (470) of a line at the radiator (420) may be determined by a used frequency and a separation distance between the substrate (110) and the metal plate antenna (430). According to an exemplary embodiment, the distal end (470) of a line at the radiator (420) may be more above disposed than an intermediate line (750) of the metal plate antenna (430) to the v direction. As a result, more than the half of the entire length of the metal plate antenna (430) may be overlapped with the radiator (420) to the v direction. Thus, a central region of the metal plate antenna (430) and the radiator (420) may be overlapped to the vertical direction.

FIG. 8 is a schematic view illustrating a return noise of an airgap antenna (100) according to an exemplary embodiment of the present disclosure.

Based on the exemplary embodiment, FIG. 8 can show the size of electrical signal returning from the airgap antenna (100) in response to the frequency at a position where the electrical signal is applied to the airgap antenna (100). The horizontal axis in FIG. 8 may show a frequency and the vertical axis may illustrate a size of return noise.

Referring to FIG. 8, it can be ascertained that a return noise is low at a relatively broad region. A common antenna has suffered from excessively peripheral problem at an actually operable region because a section where a return noise is low is excessively short. However, the airgap antenna (100) according to the exemplary embodiment of the present disclosure is operable at a relatively broad frequency because a return noise is registered to be low at a relatively broad region.

FIG. 9 is a schematic view illustrating a size of electromagnetic signal of a plurality of airgap antennas according to an exemplary embodiment of the present disclosure.

Referring to FIG. 9, an exemplary embodiment can be ascertained in which an electromagnetic signal is radiated in response to operations of four (4) airgap antennas. As evidenced by FIG. 9, although the electromagnetic signal is not radiated in a completely uniform form, it can be ascertained that the size of electromagnetic signal radiated from a plurality of airgap antennas is strong in terms of intended directions or distances.

Meantime, the aforesaid methods may be written by a program executed by a computer, and may be implemented by a general-purpose digital computer capable of operating the said program using a recording medium readable by a computer. Furthermore, data structures used in the aforementioned methods may be recorded on recording media readable by a computer through various means. The computer-readable media may comprise storage media such as magnetic storage devices (e.g., RAM, ROM, USB, floppy disk, hard disk, etc.) and optical reading media (e.g., CD-ROM, DVD).

It should be understood that numerous other modifications can be devised by those skilled in the art that will not deviate from the aforementioned essential characteristics of the technical fields related to the principles of this disclosure. Therefore, it should be understood that the above-described embodiments are not limited by any of the details of the foregoing description and drawings, but defined by appended claims, and it should be interpreted that all the differences within the equivalent scopes thereof are included in the present disclosure.

The invention claimed is:

1. An antenna comprising:

a substrate;

a radiator attached to the substrate and radiating an electromagnetic signal;

a metal plate antenna disposed to be spaced apart from the radiator in a vertical direction of the radiator;

a plurality of fixing rods supporting the metal plate antenna; and a plurality of sub patch antennas, each sub patch antenna comprising a first surface attached to one of the plurality of fixing rods and a second surface attached to the substrate, wherein a partial region of the metal plate antenna overlaps a partial region of the radiator in the vertical direction, wherein the metal plate antenna overlaps a first portion of each sub patch antenna, and wherein a second portion of each sub patch antenna extends to a position outside an outermost edge of the metal plate antenna.

2. The antenna of claim 1, wherein the metal plate antenna radiates an electromagnetic signal obtained from the radiator by coupling.

3. The antenna of claim 1, wherein the each sub patch antenna radiates an electromagnetic signal obtained from the metal plate antenna by coupling.

4. The antenna of claim 1, wherein the fixing rod is disposed to be spaced apart at a predetermined distance from a corner part of the metal plate antenna.

5. The antenna of claim 4, wherein the predetermined distance is as much as, or longer than a diameter of a cross-section of the fixing rod.

6. The antenna of claim 1, wherein a central region of the metal plate antenna overlaps the radiator in the vertical direction.

7. The antenna of claim 1, wherein a size of the metal plate antenna is determined by a frequency of the electromagnetic signal to be radiated.

8. The antenna of claim 1, wherein a separation distance between the radiator and the metal plate antenna is determined by a frequency of the electromagnetic signal.

9. The antenna of claim 1, wherein the substrate is a dielectric substrate.

10. The antenna of claim 1, wherein the metal plate antenna is shape of a square, circle, a triangle, or a pentagon.

11. The antenna of claim 1, wherein the metal plate antenna comprises a rectangular shape and extends in a first direction, and each sub patch antenna comprises a rectangular shape and extends in the first direction, wherein the partial region of the radiator overlapped with the partial region of the metal plate antenna comprises a rectangular shape extending in a second direction perpendicular to the first direction, and wherein only one corner portion of each sub patch antenna is overlapped with the metal plate antenna and the other corner portions of each sub patch antenna are positioned outside the outermost edge of the metal plate antenna.

12. The antenna of claim 11, wherein a length of the second portion of each sub patch antenna is greater than a length of the first portion of each sub patch antenna.

13. An antenna comprising:

a substrate;

a radiator attached to the substrate to radiate an electromagnetic signal;

a square-shaped metal plate antenna and disposed to be spaced apart from the radiator to a vertical direction of the radiator;

four fixing rods supporting the metal plate antenna; and four sub patch antennas attached respectively to the four fixing rods and disposed on the substrate, wherein a partial region of the metal plate antenna overlaps a partial region of the radiator in the vertical direction, and the four fixing rods are disposed respectively to be correspond to four corners of the metal plate antenna, wherein the metal plate antenna overlaps a first portion of each of the four sub patch antennas, and wherein a second portion of each of the four sub patch antennas extends to a position outside an outermost edge of the metal plate antenna.

14. The antenna of claim 13, wherein a central region of the metal plate antenna overlaps the radiator in the vertical direction.

15. The antenna of claim 13, wherein a size of the metal plate antenna is determined by a frequency of the electromagnetic signal to be radiated.

16. The antenna of claim 13, wherein a separation distance between the radiator and the metal plate antenna is determined by a frequency of the electromagnetic signal.

17. The antenna of claim 13, wherein the metal plate antenna radiates an electromagnetic signal obtained from the radiator by coupling.

18. The antenna of claim 13, wherein the four sub patch antenna radiate an electromagnetic signal obtained from the metal plate antenna by coupling.

19. The antenna of claim 13, wherein a partial region of the metal plate antenna overlaps a partial region of the radiator in the vertical direction.

20. The antenna of claim 13, wherein the four fixing rod are disposed to be spaced apart at a predetermined distance from a corner part of the metal plate antenna.

21. The antenna of claim 20, wherein the predetermined distance is as much as, or longer than a diameter of a cross-section of the fixing rod.

* * * * *